US006413012B1

(12) United States Patent
Jones

(10) Patent No.: US 6,413,012 B1
(45) Date of Patent: Jul. 2, 2002

(54) STRIPING APPARATUS FOR VEHICLE TRAVEL SURFACES

(76) Inventor: Mark Jones, 17 E. Ring Factory Rd., Bel Air, MD (US) 21014

( * ) Notice: Subject to any disclaimer, the term of this patent is extended or adjusted under 35 U.S.C. 154(b) by 0 days.

(21) Appl. No.: 09/393,466

(22) Filed: Sep. 10, 1999

Related U.S. Application Data

(63) Continuation-in-part of application No. 09/020,609, filed on Feb. 9, 1998, now Pat. No. 5,951,201.

(51) Int. Cl.[7] ..... E01C 23/22; B05B 1/28

(52) U.S. Cl. ..... 404/94; 239/150; 239/165; 239/172

(58) Field of Search ..... 404/85, 93, 94, 404/109; 222/533; 118/713; 239/150, 165, 172, 166; 280/400

(56) References Cited

U.S. PATENT DOCUMENTS

| | | | | | |
|---|---|---|---|---|---|
| 4,267,973 | A | * | 5/1981 | Stewart | 239/73 |
| 4,447,007 | A | | 5/1984 | Farines | 239/165 |
| 4,518,121 | A | | 5/1985 | Smith | 239/526 |
| 4,873,818 | A | | 10/1989 | Turner | 56/10.8 |
| 4,930,935 | A | | 6/1990 | Quenzi et al. | 404/75 |
| 5,054,959 | A | * | 10/1991 | Wilson et al. | 404/94 |
| 5,076,042 | A | | 12/1991 | Koorn et al. | 56/6 |
| 5,114,268 | A | | 5/1992 | Marcato | 404/92 |
| 5,169,262 | A | * | 12/1992 | Wilson et al. | 404/84.05 |
| 5,302,207 | A | | 4/1994 | Jurcisin | 118/713 |
| 5,368,232 | A | | 11/1994 | Schroeder | 239/165 |
| 5,599,133 | A | * | 2/1997 | Costello et al. | 404/72 |
| 5,621,978 | A | | 4/1997 | Sarauer | 33/503 |
| 6,027,281 | A | * | 2/2000 | Neuling | 404/75 |
| 6,174,104 | B1 | * | 1/2001 | Fields | 404/94 |

* cited by examiner

*Primary Examiner*—Gary S. Hartmann
(74) *Attorney, Agent, or Firm*—Law Offices of Royal W. Craig

(57) ABSTRACT

A reflective bead dispensing apparatus which works in conjunction with any prior art airless walk behind striping equipment. This reflective bead dispensing and paint dispensing apparatus is attachable to the rear of a vehicle. Compressed air and the vehicle's electrical system control all operations. The bead dispensing apparatus has an telescoping boom capable of pivoting around the point of attachment and extends outwardly from the point of attachment. At the end of the telescoping boom is the wheeled paint carriage which contains an air compressor, air tank, warning light, flood lights, the brake/hazard/turn signal lights, paint spray gun mounts, and reflective bead hoppers and dispensers. The carriage can pivot around the attachment point to the boom. The reflective beads are applied onto the wet paint already applied to the surface. The carriage pivots between a lowered position during striping operations and a locked upright position during relocation. The carriage mounts to a detachable trailer behind the vehicle during transport or can be placed into the back of a vehicle. The vehicle contains paint and a prior art pump which pushes the paint through hoses to the prior art spray guns on the carriage. A jack with an elongated wheeled foot can be lowered for ground support during mounting and removal of the apparatus from the vehicle, and also during transformation from a towing configuration into a striping configuration. A line guide is detachably mountable to the vehicle's front bumper. A remote control box enables operation of all functions of the apparatus by the vehicle's driver.

13 Claims, 15 Drawing Sheets

STRIPING APPARATUS FOR VEHICLE TRAVEL SURFACES

CROSS-REFERENCES TO RELATED APPLICATIONS

This application is a Continuation-In-Part of Non-Provisional Application Ser. No. 09/020,609 which was filed on Feb. 9, 1998 and which is assigned U.S. Pat. No. 5,951,201 and issued on Sep. 14, 1999.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION (1) Field of the Invention

This invention relates to an apparatus for the application of paint and reflective beads to a surface, specifically to an apparatus detachable securable to the back of a truck or similar vehicle.

(2) Description of the Related Art

Stripes are applied to roadways, parking lots, warehouse floors, and the like for directing the movement and placement of vehicles. Durable paints are sprinkled with small reflective glass beads to ensure long term nighttime visibility of the lines with vehicle headlights.

Prior art painting systems used to apply marking lines to long lengths of highway generally use large vehicles dedicated to single use. Because of their large size, lack of maneuverability, high labor consumption and expense, these machines are generally inappropriate for use on smaller projects, such as parking lots, warehouse floors, short sections of highway repair and the like. Such applications generally require enhanced maneuverability because of short lines, line discontinuity, and the presence of obstacles to be avoided.

Prior art systems installed in a truck bed and/or a truck chassis, typically require extensive modifications to the vehicle, and require means for powering the painting apparatus from dedicated motors, paint pumps and air compressors on the apparatus, or vehicle engine. Use of such machines typically require one or two riding operators in addition to the vehicle driver. Such spray units are dedicated to the single purpose of roadway line striping.

In these vehicle mounted units, mounting and dismounting of the paint striping apparatus is generally a long and arduous process. Storage of these units is often difficult due to their large size.

In addition, the repainting of existing roadway striping requires an operator to manually adjust the position of the spray guns for accurate retracing.

Prior art systems for applying traffic control lines, such as U.S. Pat. No. 5,368,232, generally utilized motors, paint pumps, paint spray guns, and air compressors dedicated for use only on said equipment. These components add greatly to the cost of the apparatus. Furthermore, the apparatus claimed and disclosed in U.S. Pat. No. 5,369,232 can not have all of its components controlled by the operator of the vehicle during usage of the apparatus while the operator remains in the vehicle. The apparatus requires a person to manually extend and retract part of the device during use. In addition, the beads can not flow easily from the bead holder to the applicator.

Prior art airless walk behind striping machines are widely used for striping parking lots, warehouse floors, short sections of highway repair and the like. The walk behind machine is ideal for striping short lines, but its short wheel base makes it extremely difficult to obtain accurate and straight long lines. Attempting to paint roadway stripes with a walk behind machine also exposes the operator to the dangers of other vehicular traffic.

BRIEF SUMMARY OF INVENTION

It is an object of this invention to have a device for the application of paint and reflective material to a surface. The reflective material could be glass beads, metal beads, or other material that reflects light.

It is an object of this invention to have an apparatus that can be easily attached to and detached from the rear of a vehicle at a boom-vehicle attachment point so that the striping machine can be easily stored and does not require a dedicated vehicle for operation. It is also an object of the invention to provide for easy storage because of the device's small size and light-weight.

It is an object of the invention that the paint and pumping system can be stored in the back of the vehicle while the reflective beads and all other equipment are stored and contained on the apparatus.

It is also an object of this invention to have a telescoping boom so that the paint applicators, bead applicators and other equipment, except for the paint and pumping system, are located above the area to be striped. Another object is for the vehicle to which the striping apparatus is attached to be able to travel on the main part of the road while striping the side or the middle of the road. To accomplish this objective, the telescoping boom and the carriage which holds the paint applicators, bead applicators and other equipment except the paint and pumping system must be able to pivot at the boom-vehicle attachment point from directly behind the vehicle to either the left side or the night side of the vehicle. As such, it is an object of the invention that the apparatus can stripe a surface to the left side and right side of the vehicle. In addition, it is an object of the invention that the carriage be able to pivot at the boom-carriage attachment point around the end of the telescoping boom so that the paint guns and bead dispensers are in the correct orientation regardless of which side of the vehicle to which the carriage is placed.

It is an object of this invention that the telescoping boom be able to extend and retract. It is also an object of this invention that the extension and retraction of the telescoping boom be controllable from a control box that can be placed in the cab of the vehicle.

It is an object of this invention that the apparatus be able to use any non-proprietary paint spraying equipment. This invention permits a wide variety of non-dedicated independent equipment to be used without modification of the equipment. Companies in the business of parking lot striping and those who already utilize walk behind airless striping machines may expand their business into roadway striping without purchasing additional and dedicated paint pumping systems. This versatility in equipment permits the user to provide high quality roadway striping without the enormous expense generally incurred.

It is also an object of this invention that the device could use dedicated paint spraying equipment that is attached to the carriage.

It is an object of this invention to provide illumination of the work site so that one can operate the device at night. It is also an object of the invention to warn others that the surface is being striped by illumination of warning lights and signaling lights on the apparatus.

It is also an object of this invention that the device can be quickly and easily converted from an operating configuration into a transport configuration for driving at high speeds on highways and other roads.

It is an object of this invention that the apparatus can be transported to the work site on a detachable trailer while hooked to the vehicle.

It is an object of the invention that a wheel, skip timer, and distance timer are used so that the apparatus can automatically start and stop applying paint and reflective beads.

It is an object of the invention that the distance from the surface to the paint spray guns and the reflective bead dispenser be adjustable by adjusting the height controller. Furthermore, it is an object that the distance can vary to account for bumps and dips in the surface being striped.

It is an object of this invention that a sleeve protect the reflective beads as the beads travel from the bead dispenser to the surface. Because wind, rain, discharge from the paint guns, and other external forces can interfere with the distribution of the reflective beads as the reflective beads fall from the bead dispenser to the surface, it is useful to have a sleeve to protect the beads and help keep them properly aligned for application to the surface. It is also an object that the sleeve be somewhat rigid but also flexible. It is also an object that the sleeve be removable for easy cleaning.

It is an object of this invention that the paint applicators and the reflective bead applicators be controlled from a control box that can be operated by a person in the cab of the vehicle. It is an object of this invention that the driver of the vehicle be able to control the application of paint and reflective beads while driving the vehicle.

It is an object of this invention that the height controller be controlled from a control box that can be operated by a person in the cab of the vehicle. It is an object of this invention that the driver of the vehicle be able to control the height controller while driving the vehicle.

It is an object of this invention that the illumination lights, warning lights, and signaling lights be controlled from a control box that can be operated by a person in the cab of the vehicle. It is an object of this invention that the driver of the vehicle be able to control the operation of the illumination lights, warning lights, and signaling lights while driving the vehicle.

It is an object of the invention that the electrical components of the device be able to use power from a battery or a generator. It is an object of this invention that all electrical components of the apparatus be controlled via the control box. It is an object of this invention that the driver of the vehicle be able to control all electrical components of the apparatus while driving the vehicle.

It is also an object of the invention that the control box control air valves in the device. It is also an object of the invention that the driver of the vehicle be able to operate all of the air valves of the apparatus from the vehicle's driver seat using a remote control box.

It is an object of the invention that the device be small in size and lightweight for use with a small vehicle, if desired.

Still further objects and advantages will become apparent from a consideration of the ensuing description and drawings.

DETAILED DESCRIPTION OF THE INVENTION

Figure 1:
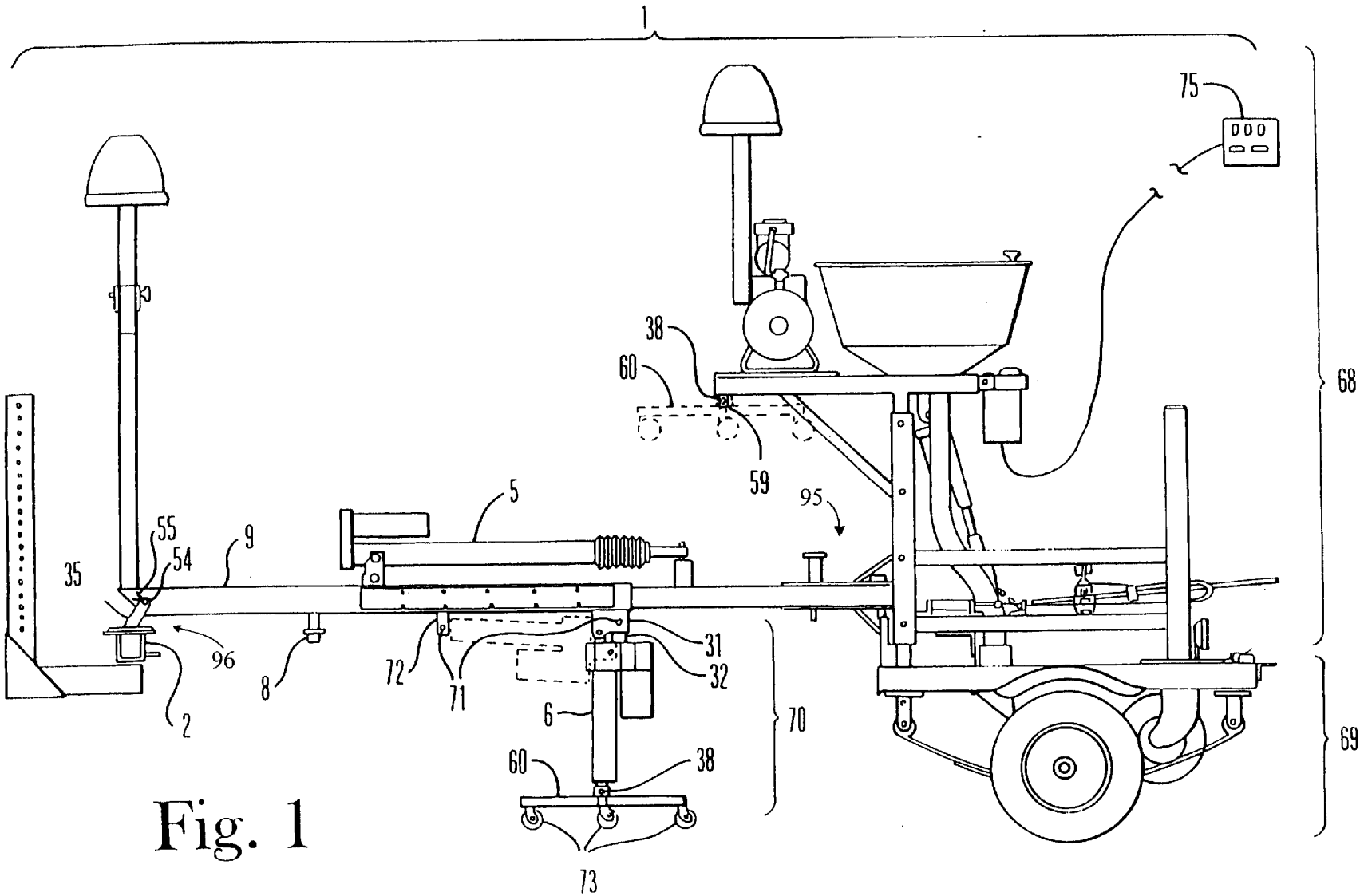
FIG. 1 is a side view of the striping apparatus with the carriage resting in the detachable trailer.
Figure 2:
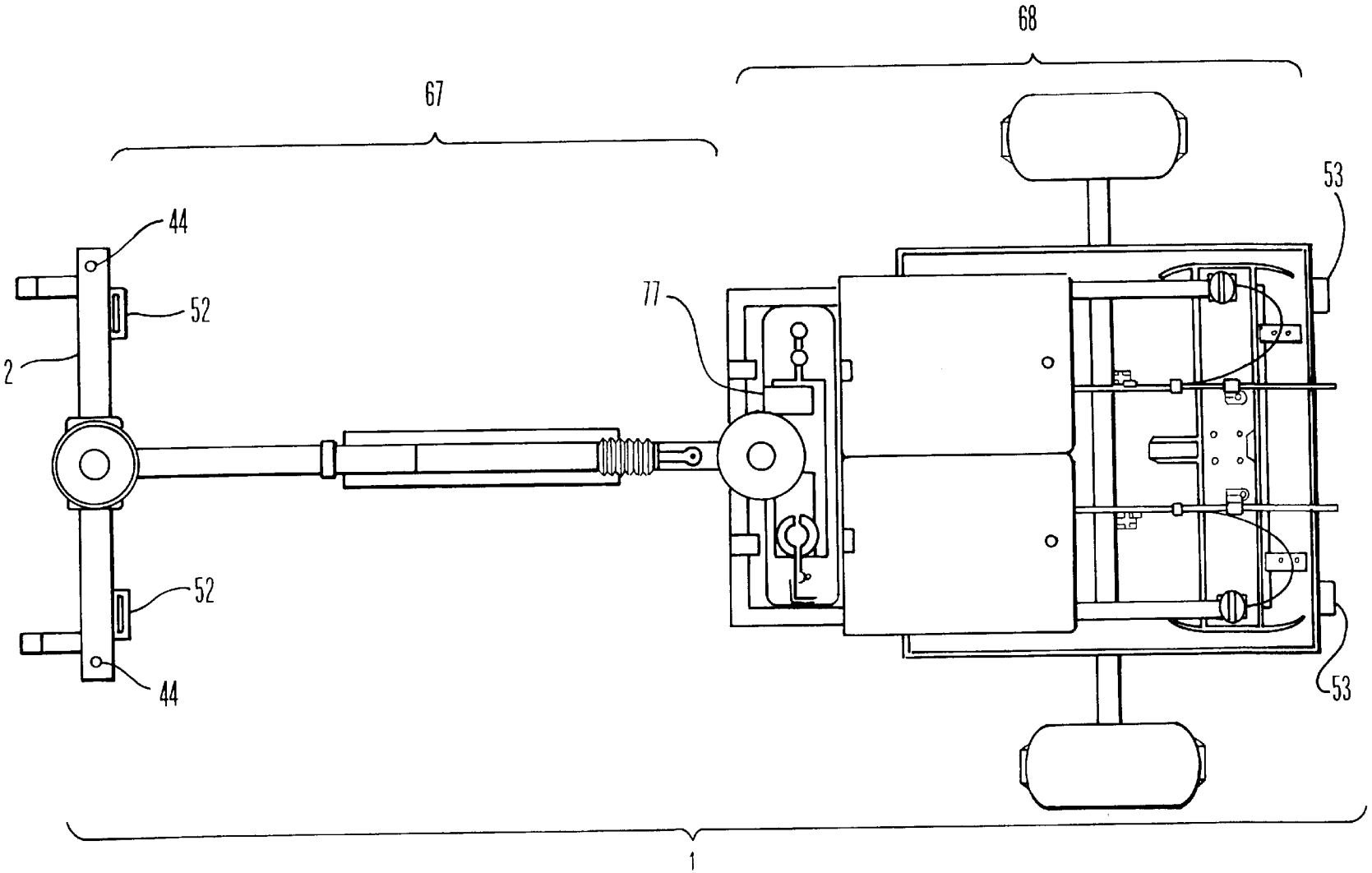
FIG. 2 is a top view of the striping apparatus with the carriage resting in the detachable trailer.

In FIGS. 1 and 2, the primary structural elements of the striping apparatus, 1, include a crossframe, 2; a telescoping boom, 67, pivotally attached to the crossframe at the boom-vehicle attachment point, 96, and extendable from either the left or right side of the crossframe; a carriage, 68, attached to the telescoping boom at the boom-carriage attachment point, 95, which may pivot 180 degrees around the end of the telescoping boom at the boom-carriage attachment point; a detachable trailer, 69, in which the carriage mounts during transport; and a jack, 70, pivotally mounted beneath the telescoping boom.

The jack, 70, consists of a jack foot, 60, with three, four, or more casters, 73, mounted to the bottom of the jack foot, a jack actuator, 6, a jack housing, 31, and a jack housing insert, 32. The jack foot, 60, is removably attached to the bottom of the jack actuator, 6, and is held in place with a removable set pin, 38. The jack actuator is pivotally attached to the bottom of the telescoping boom, 67, beneath the outer boom, 9, at the jack housing, 31, and secured in place with a jack set pin, 71, which transverses the jack housing and the jack housing insert, 32. The jack, 70, permits the entire striping apparatus, 1, to be rolled along the ground and stored in such a position as to enable rapid mounting to or dismounting from a vehicle. When the striping apparatus is mounted to the vehicle, the jack actuator, 6, may be activated from the control box, 75; lifting the jack foot, 60, off the ground. Then one removes the removable set pin, 38, and detaches the jack foot from the jack actuator. Next, one removes the jack set pin, 71, and pivots the jack actuator by ninety degrees at the jack housing, 31, bringing the bottom of the jack actuator towards the vehicle, until the jack actuator is parallel to and adjacent to the telescoping boom, 67. Then one secures the jack actuator to the outer boom by inserting the jack set pin, 71, through the set pin hole at the bottom of the jack actuator and through the hole in the jack/outer boom connector, 72. Thus, the weight of the striping apparatus in no longer supported by the jack. One can store the jack foot, 60, in the vehicle when the jack foot is not attached to the jack actuator, 6, or one can store the jack foot on the carriage by securing it to the jack foot mount, 59, using the set pin, 38.

Figure 4:
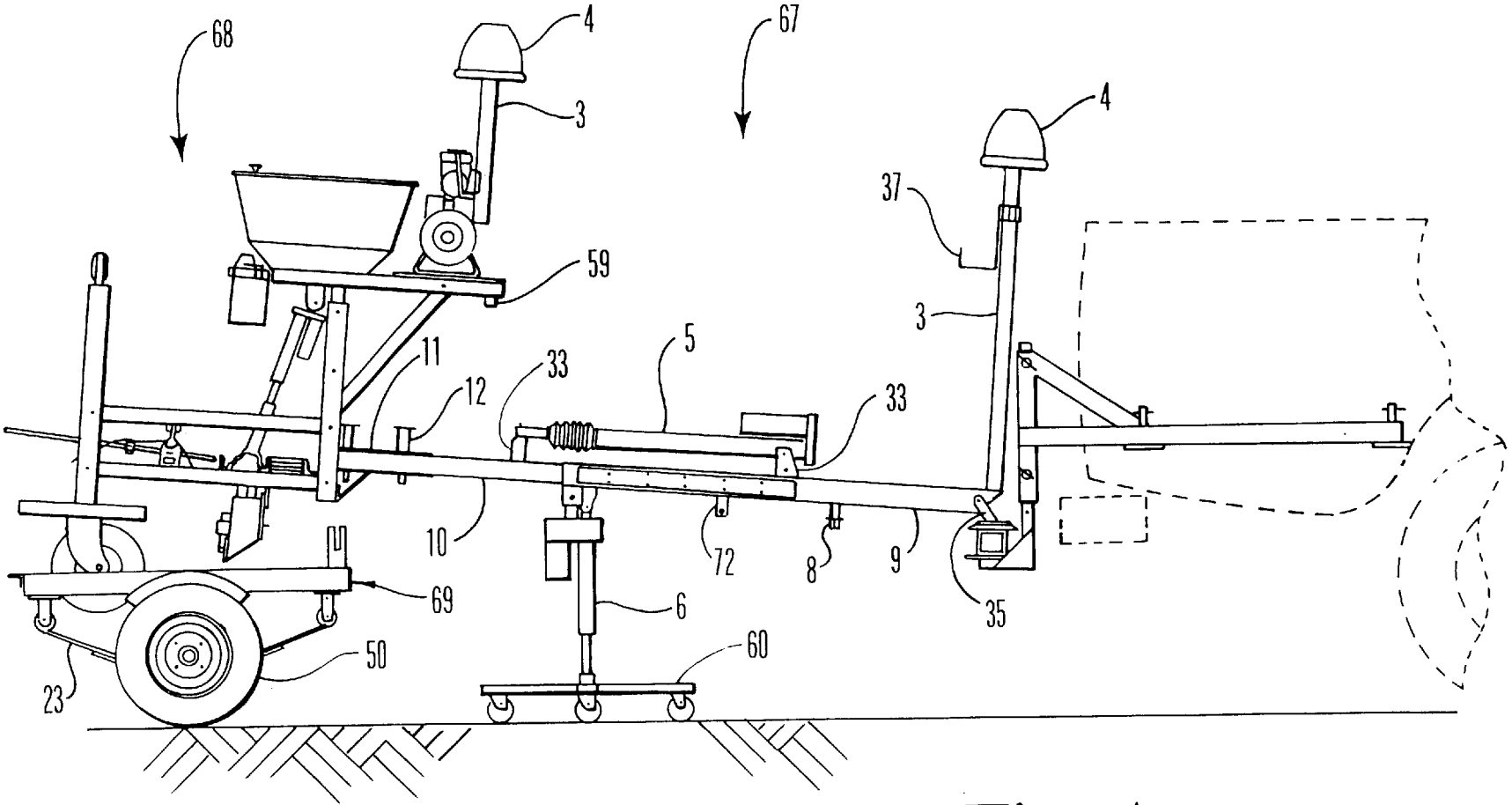
FIG. 4 is a side view of the striping apparatus with the jack raised and the carriage lifted out of the detachable trailer.

In FIG. 1 and 4, when one arrives at the work site or when one wants to remove the striping apparatus from the vehicle, one removes the jack set pin, 71, from the jack/outer boom connector, 72, pivots the jack, 70, downward, places the jack set pin into the jack housing, 31, reattaches the jack foot, 60, to the bottom of the jack actuator, 6, using the removable set pin, 38, and then extends the jack actuator, 6, until the castors, 73, contact the ground.

Figure 3:
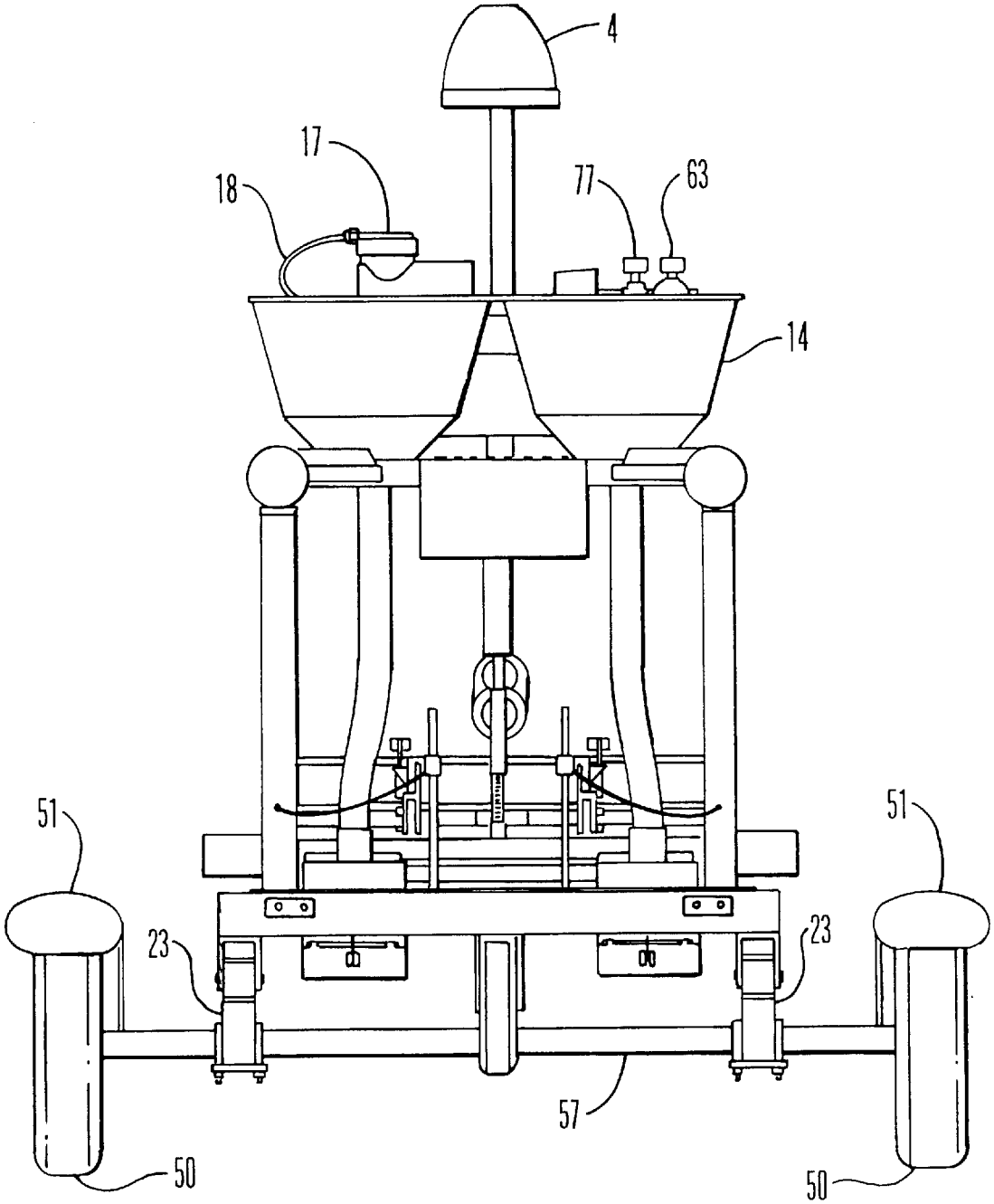
FIG. 3 is a back view of the striping apparatus with the carriage resting in the detachable trailer.

In FIGS. 1, 3, and 4, the invention contains a detachable trailer, 69, which can be used when transporting the apparatus. The carriage, 68, can sit inside the detachable trailer and is securely held in place by trailer set pins, clamps, and other types of fasteners. The actual position of the fasteners which secure the detachable trailer and the carriage together is not vital, so long as the fasteners are easily accessible and easy to attach and detach. The detachable trailer contains springs, 23, an axle, 57, tires, 50, and fenders, 51.

In FIGS. 2 and 4, before one operates the striping apparatus, the detachable trailer, 69, must be removed. After removing the fasteners one places the jack, 70, in the vertical position, and uses the control box, 75, to extend the jack actuator, 6, thereby raising the carriage upwardly until it no longer touches the detachable trailer. Then one can remove the detachable trailer and stores it in the vehicle. Alternatively one can store the detachable trailer on the striping apparatus by placing the trailer brackets, 53, into the trailer housing, 52, which are located on the crossframe, 2, and securing the detachable trailer to the strobe light stand, 3, on the telescoping boom, 67, via the trailer hold down, 37.

Figure 5:
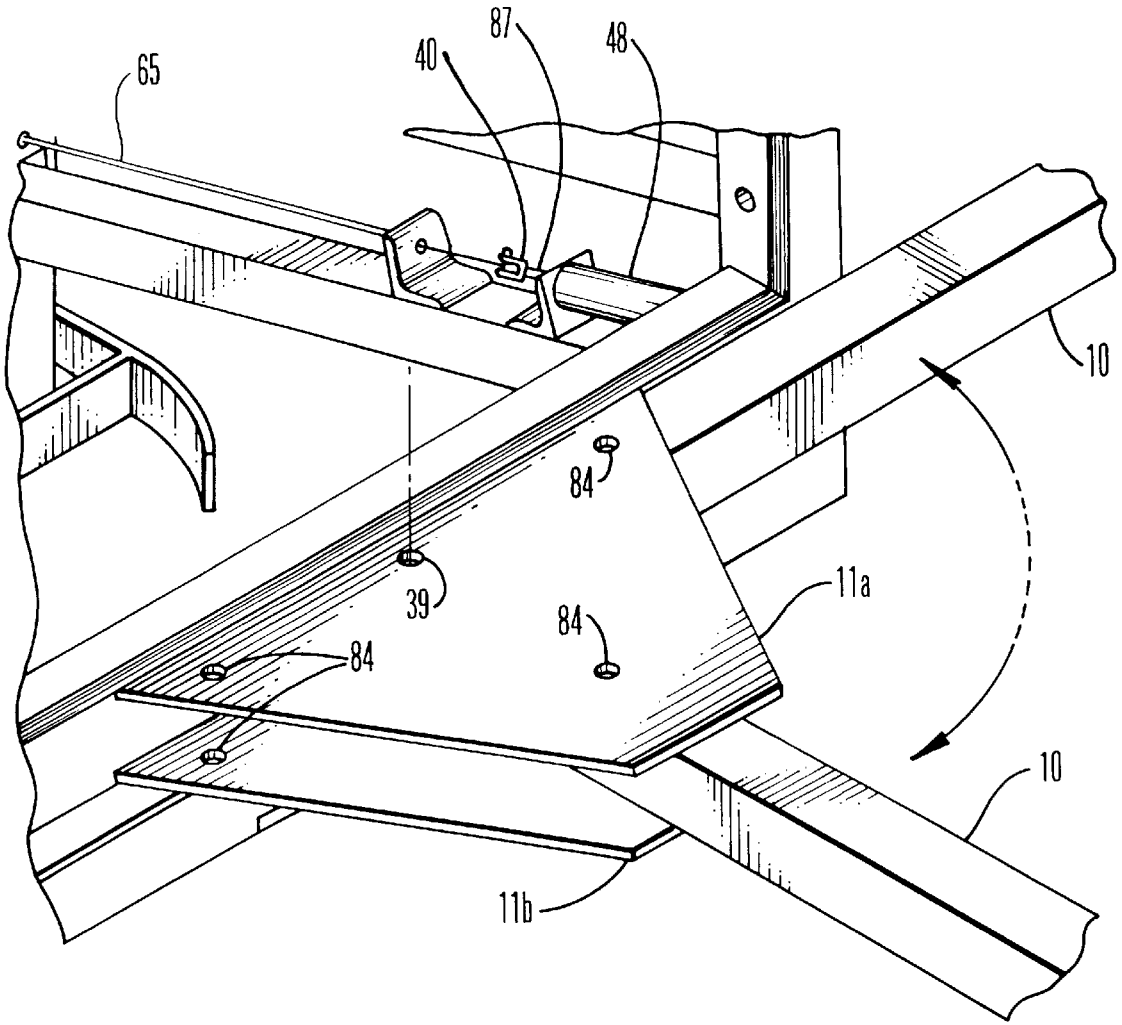
FIG. 5 is a enlarged view of the pivot plates and the connection of the telescoping boom to the carriage.

After the jack has been raised and the carriage has cleared the detachable trailer, the telescoping boom may then pivot to either the right or left side of the vehicle at the boom-vehicle attachment point, 96, by pushing the carriage or the telescoping boom to the right or left side of the vehicle. The boom swivel caster, 35, turns as one pushes on the carriage or the telescoping boom. See FIGS. 1, 4, and 7. The boom swivel caster is securely mounted to the crossframe, 2. While a boom swivel caster is the preferred embodiment, other methods of enabling the telescoping boom to pivot at the boom-vehicle attachment point exist, such as ball and socket joints, hinges, pivot plates, 11 (see FIG. 5), and/or a combination of these. The telescoping boom should be able to pivot approximately 180 degrees from one side of the vehicle to the other side. See FIGS. 4 and 7.

In FIGS. 2 and 4, a boom leveling nut, 8, is mounted beneath the outer boom, 9. The boom leveling nut is a threaded cap on a threaded piece of metal or other material. By turning the cap, one can extend or reduce the length of the boom leveling nut. After one pivots the carriage and the telescoping boom to either to the right or left of the vehicle, one aligns the boom leveling nut with the leveling nut housing, 44, located in the crossframe. Then the jack actuator, 6, is retracted, lowering the boom leveling nut into the leveling nut housing. By increasing the length of the boom leveling nut, one can compensate for any axial movement of the crossframe, 2, caused by an unbalanced weight distribution, and thereby insuring the telescoping boom will remain level with the roadway surface. The leveling nut housing also locks the telescoping boom into position for striping because once the leveling nut is in the leveling nut housing the telescoping boom can not swivel. Prior to striping, the jack actuator, 6, should be retracted completely; the jack foot, 60, removed, and the jack, 70, pivotally mounted beneath the outer boom, 9. See FIG. 1. Thus, the jack plays several roles. It acts as a stabilizing leg when the invention is not attached to a vehicle. It makes it easy for someone to move or roll the invention when the invention is not attached to a vehicle. It also raises and lowers the carriage when the apparatus is attached to a vehicle. It also makes it easy for someone to push the telescoping boom or carriage to the left or right side of a vehicle when the apparatus is connected to a vehicle and the jack is extended to the ground.

The carriage, 68, is attached to the end of the telescoping boom, 67, at the boom-carriage attachment point, 95. (See FIGS. 1 and 2) The carriage can pivot approximately 180 degrees around the end of the telescoping boom. While various methods exist to permit the carriage to pivot, such as hinges, ball and socket joints, and separate connecting points, the preferred method involves a pivot plate, 11, (see FIG. 5) consisting of two parallel plates, 11*a* and 11*b*, securely attached to the carriage. The distal end of the inner boom, 10, lies between the pivot plate and is securely attached to the plate via a pivot bolt, 39, or a pin or other fastener that transverses the pivot plate and the inner boom. (See FIG. 6) The carriage can pivot around the inner boom by swinging around the pivot bolt. The pivot plate can be almost any shape. The parallel plates contain three pivot holes, 84, set 90 degrees from the pivot bolt and each other and are equidistant to the pivot bolt. The inner boom also contains a pivot hole which aligns with and corresponds to the pivot holes. In FIG. 4, the pivot set pin, 12, slides through the one of the pivot holes on the pivot plate and the inner boom to secure the carriage to the telescoping boom. During normal usage and storage of the striping apparatus, the pivot bolt is never removed. Thus, by removing the pivot set pin, the carriage can pivot 90 degrees from center configuration around the telescoping boom into proper striping configuration. See FIGS. 7 and 10.

Figure 7:
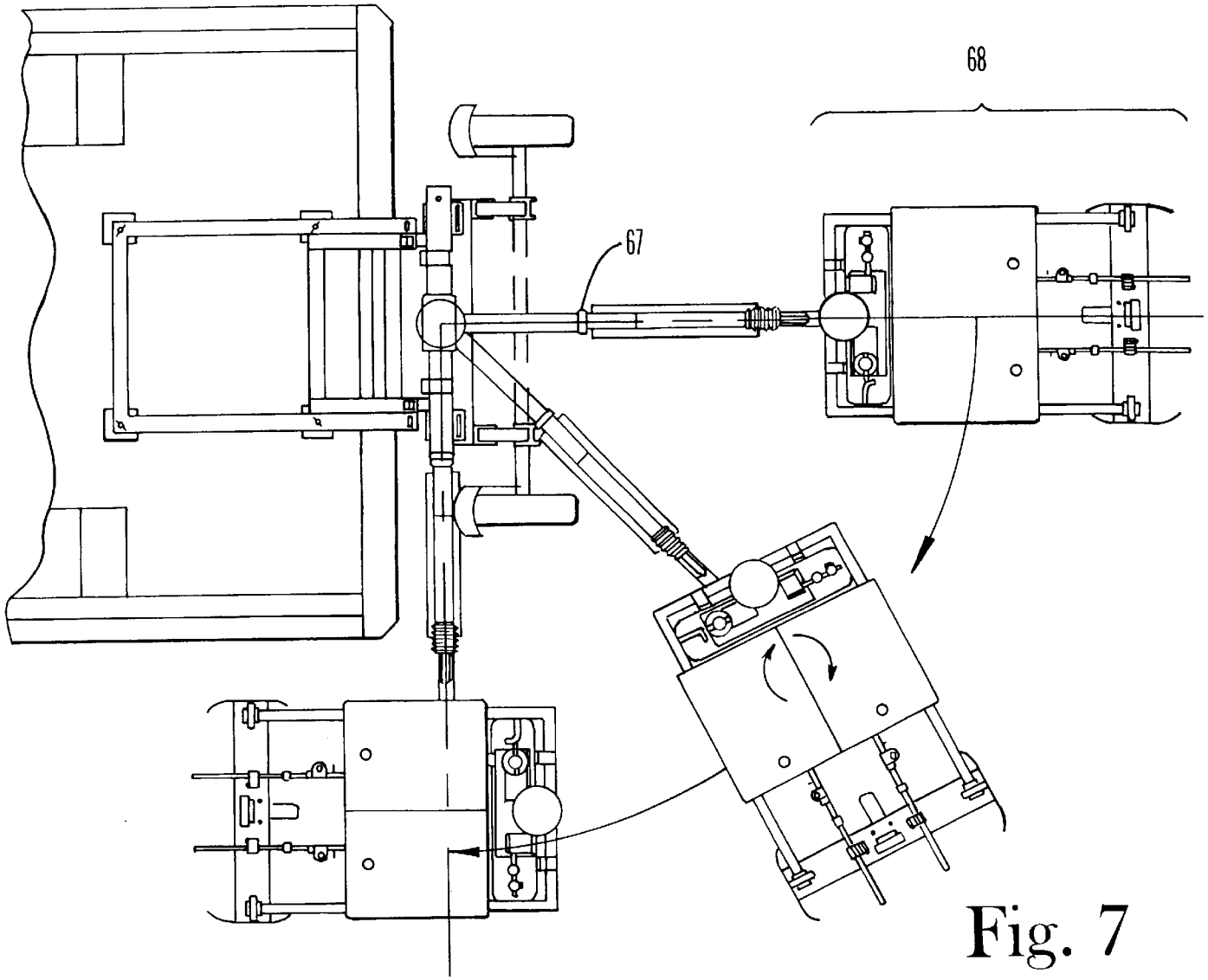
FIG. 7 is a top view demonstrating the ability of each section of the striping apparatus to pivot and each section's position upon pivoting.

Because of the ability of the carriage to pivot around the end of the telescoping boom, the paint applicators and bead applicators will be in proper alignment for striping, regardless of on which side of the vehicle one stripes; the paint will be applied first, then the reflective beads. In FIG. 7, because of the ability of the telescoping outer boom to pivot 180 degrees at the boom-vehicle attachment point, and because of the ability of the carriage to pivot 180 degrees at the boom-carriage attachment point, the striping apparatus, 1, can be locked into proper configuration for line striping on either the left side or the right side of the vehicle.

Figure 8:
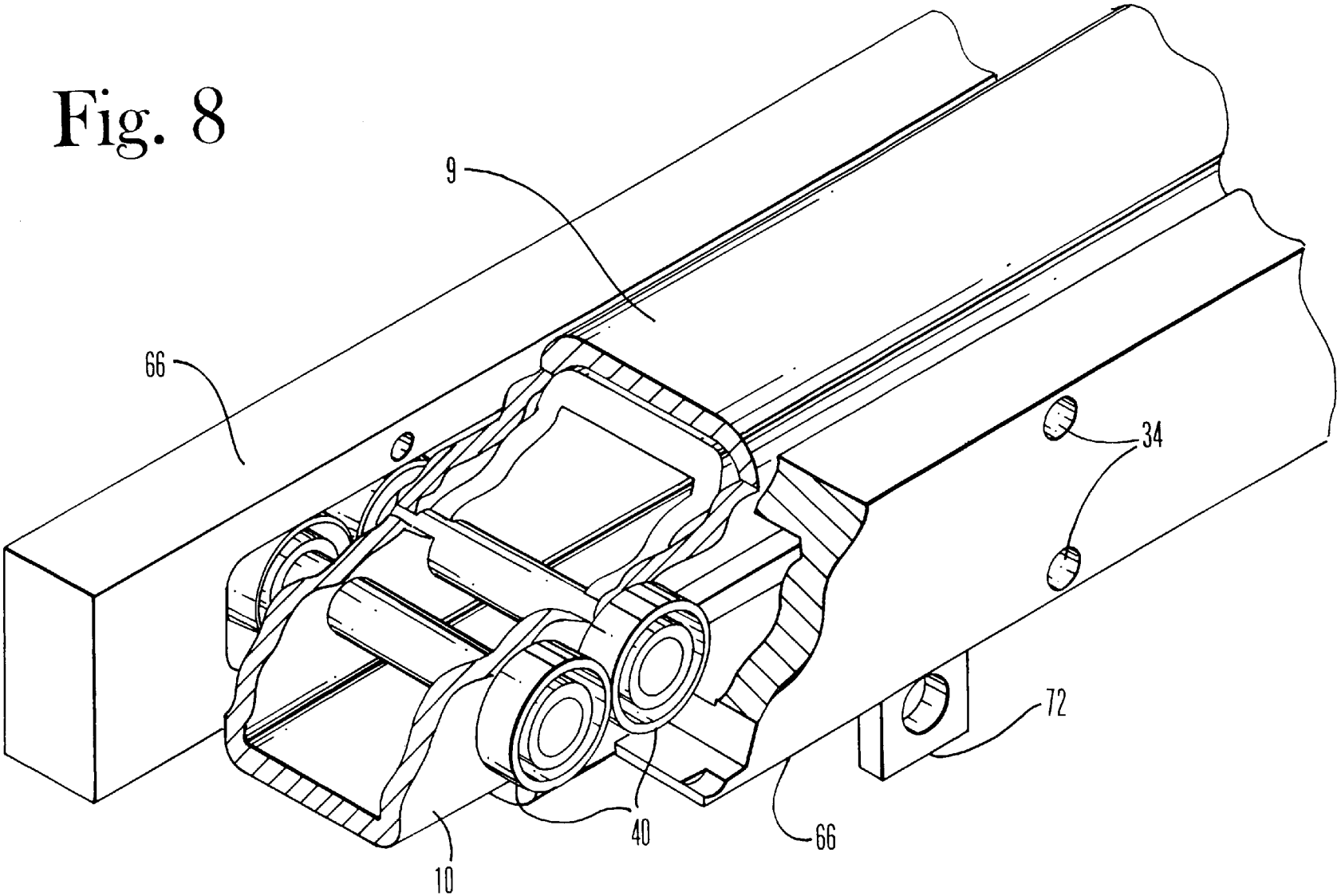
FIG. 8 is a detailed cut-away view of the telescoping boom and the roller bearing tracks.

The crossframe, 2, can be square tubing beams, or other type of beam made from steel, aluminum or other type of material which can support the weight of the invention, welded together into a horizontal base. In FIG. 1, the telescoping boom, 67, is attached to the crossframe with a boom swivel caster, 35, and a cross pin, 54, and a retaining pin, 55. The telescoping boom can pivot around the boom-vehicle attachment point on the boom swivel caster. (See FIG. 7) In FIGS. 4 and 8, the telescoping boom contains an inner boom, 10, and an outer boom, 9, which is of greater diameter than the inner boom. The inner boom slides inside the outer boom, along two roller bearing tracks, 66, each of which are securely attached to the outside of the outer boom via bearing track screws, 34. The inner boom has two or more axle-separated roller bearings, 40. The axle-separated roller bearings travel along the roller bearing tracks. The outer boom is slotted to accommodate the axle-separated roller bearings' movement. The inner boom can extend distally outward from the end of the outer boom to beyond the side of the vehicle. The roller bearing tracks prevent axial forces from twisting and seizing the inner boom within the outer boom during the extension or retraction of the telescoping boom. In FIG. 4, an electromechanical linear actuator, the boom actuator, 5, is securely mounted at one end to the outer boom and at the other end to the inner boom via boom actuator mounts, 33, which can be brackets, pins, welding, or other fasteners. The boom actuator pushes and/or pulls the inner boom along the roller bearing tracks, thus causing the telescoping boom to extend or contract in length. The boom actuator is operated from the control box, 75. The telescoping boom can be made from any suitable material which can support the weight of the invention, such as steel, aluminum, and carbon composite material.

In FIGS. 3, 6, 9, and 10, the carriage contains several components, including one or more bead applicators, one or more paint applicators, a height controller, warning lights, work illumination lights, wheel, a skip timer, and a distance timer. It can also contain an air compressor, 17, an air tank, 16, a connecting tube between the air compressor and the air tank, 18, and an electrical relay box, 19. The warning lights can be strobe lights, 4. The work illuminating lights can be flood lights, 20.

The carriage's frame can be made from steel, aluminum, wood, or any other suitable material that can support the weight of the components. Aluminum is preferable because of its strength and light weight. The carriage can be divided into two sections, the upper section and the lower section. In the lower section, the carriage has an upper control arm, 21, and a lower control arm, 25, on the right and left side of the frame. Each end of the upper control arm and lower control arm are attached to carriage uprights, 29, in such a manner as to permit the upper and lower control arms to pivot vertically. One such method of attachment is to use hinges. A preferable method is to have a hole in the carriage uprights into which each upper and lower control arm fit, insert each control arm into its respective hole, then place a bolt through the carriage uprights and through the control arms. One can secure the bolt with a nut. There are one or more crossbeams, 78, between the carriage uprights on the sides that lack the upper control arms and the lower control arms, and between the lower control arms. The crossbeams are securely attached to the carriage uprights and to the lower control arms. The crossbeams prevent the carriage from twisting axially or moving side to side. By stabilizing the carriage, the crossbeams prevent the paint applicator and the reflective bead applicator from moving out of line. In addition, the lower control arms are crossbraced with the bead dispenser beam, 42. The bead dispenser beam and the crossbeams permits the lower control arms to pivot up and down yet prohibit side-to-side movement which can produce crooked paint lines and reflective bead lines. The bead dispenser beam is slotted. The pivot plate, 11, is securely attached to one or more crossbeams.

Attached to the top of one set of the carriage uprights, 29, is a platform which can be known as the upper section of the carriage to which is attached the air tank, 16, the air compressor, 17, one or more bead hoppers, 14, into which reflective beads are placed, an electric relay box, 19, one or more flood lights, 20, one or more strobe lights, 4, one or more strobe light stands, 3, and a lift actuator mount, 74. The upper section of the carriage also contains the jack foot mount, 51, which can hold the jack foot, 60, when the jack foot is not in use on the bottom of the jack actuator, 6.

The height controller is attached, at one end, to the upper section of the carriage and, at the other end, to the lower section of the carriage. In the preferred embodiment, the height controller has a lift actuator, 7, attached to the lift actuator mount, 74. The other end of the lift actuator is attached, via chain links, 41, and the bead dispensing beam, 42, to the lower control arms in the lower section of the carriage. The lift actuator is an electro-mechanical linear actuator which can be operated from the control box, 75. One can activate the lift actuator, shortening its length, thereby pulling on the lower control arms, 25, and raising the carriage, 68, away from the striping surface. (See FIG. 6*a* and 6*b*). By lifting the carriage, the entire apparatus is support by the vehicle and permits slow speed relocation of the striping operation. The upper control arms and lower control arms and the lift actuator permit the carriage to be raised from the surface yet maintain parallel position to the telescoping boom, 67. The chain links permit the carriage to move up and down independently from the lift actuator. In such a manner, the carriage can travel over surface irregularities with ease. In addition, the lift actuator and chain links help secure the carriage to the detachable trailer.

Figure 6B:
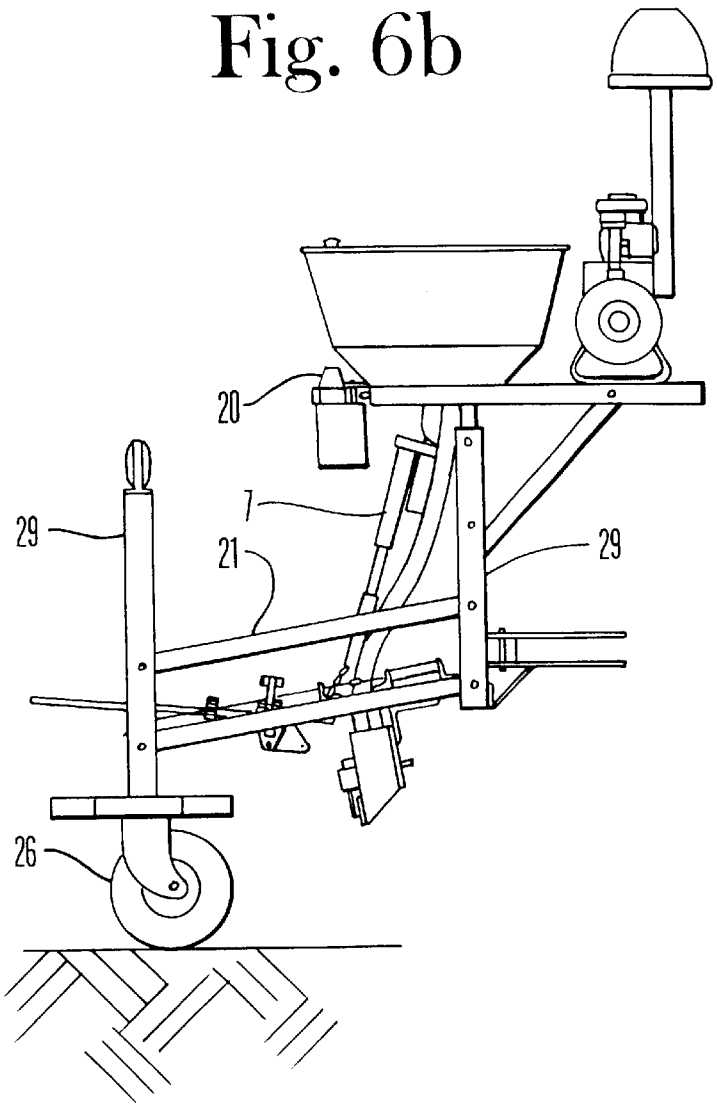
FIG. 6*b* is a side view of the carriage with the lift actuator extended until the carriage is resting on the ground.
Figure 9:
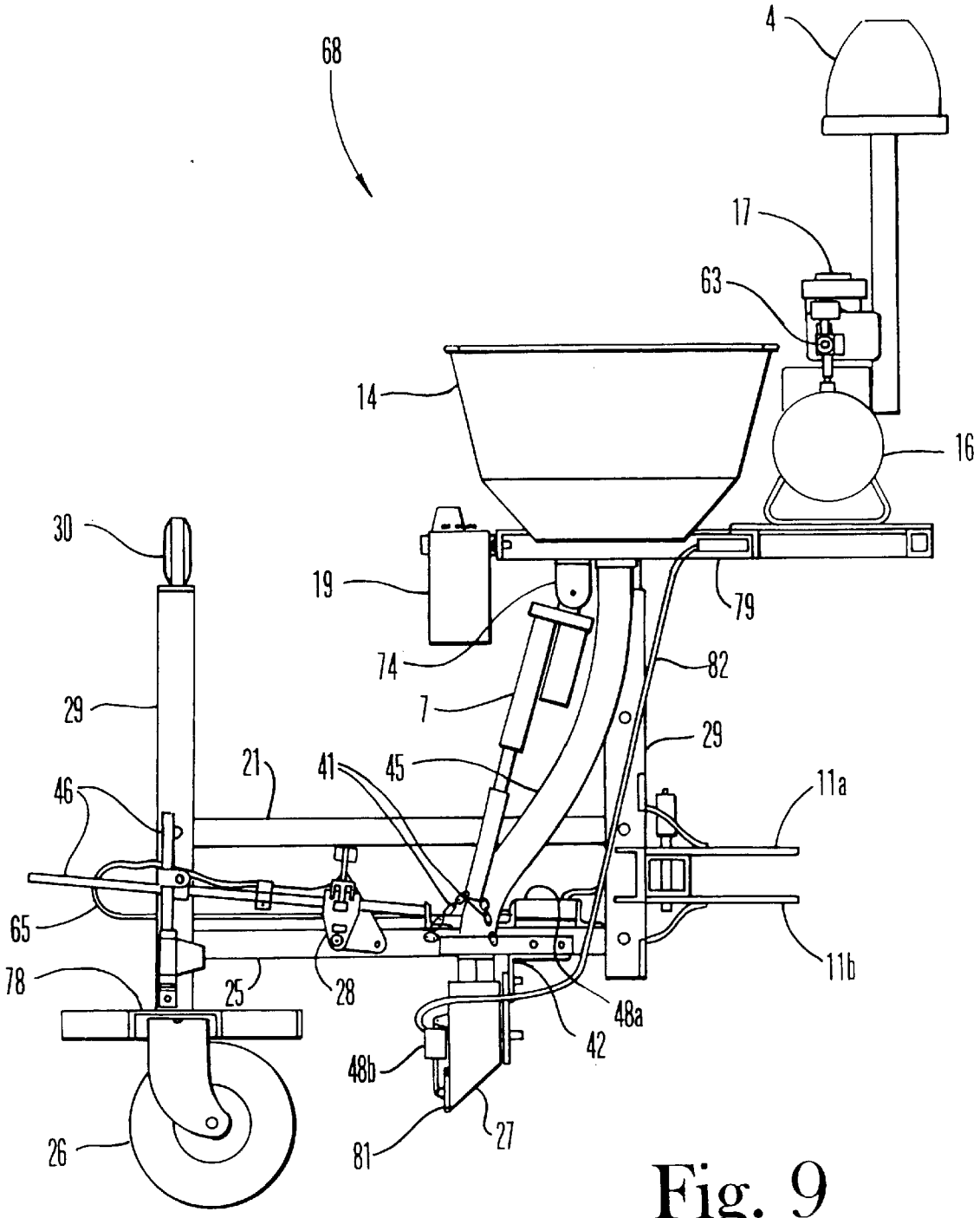
FIG. 9 is a cut-away side view of the carriage along line A in FIG. 3.

In FIGS. 6*b* and 9, a pneumatic wheel, 26 is swivelably mounted beneath the carriage, 68, so that the carriage can ride smoothly over any surface irregularities, thereby helping to maintain the desired spray distance and line width. The pneumatic wheel prevents wobble of the carriage during striping operations. The pneumatic wheel may also serve to provide a travel distance signal for a skip timer controller, whereby a discontinuous paint stripe or stripes having a specified line length and skip length, may be applied. A distance sensor, having a magnetic, or other signal pickup, transmits a signal used for distance determination by the skip timer controller. Such a skip timer controller may be used to conform the newly painted and beaded stripes to coincide with, and cover, existing broken stripes. The functions of the skip timer controller are typically incorporated into the control box for operations by the driver of the vehicle. A distance sensor determines the length of a painted stripe, and the distance between longitudinally spaced stripes, receiving distance signals based on the rotation of the pneumatic wheel. The skip timer controller is adjustable to uniformly control the stripe and interstripe, i.e., gap, distances of either the left or right stripe, or both stripes through switches. These switches effectively override switches to apply a repeating time function to the activation of the valves controlling the flow of paint and beads. Electrical circuits for skip timer controllers are known in the art. The precise starting point and ending point for each stripe section may be controlled to permit the overcovering of previously applied discontinuous stripes.

Figure 6A:
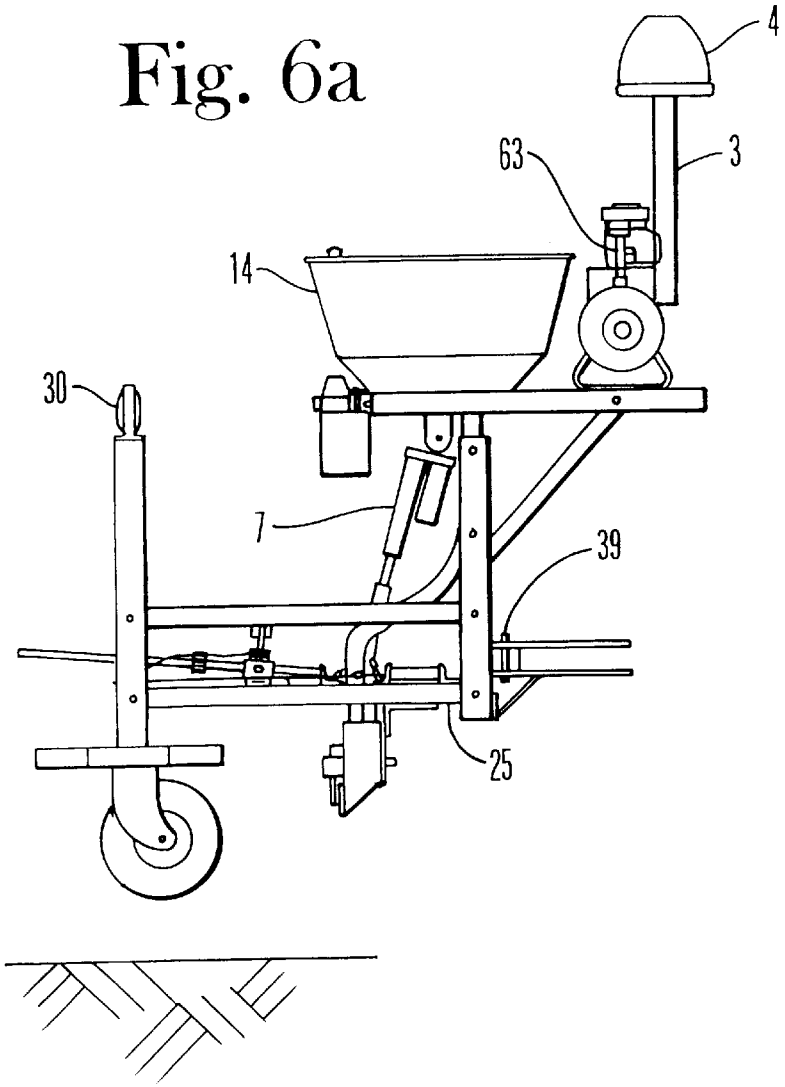
FIG. 6*a* is a side view of the carriage with the lift actuator shortened to lift the carriage off the ground.

In FIGS. 6*a*, 6*b*, and 9, the apparatus, while mounted in the detachable trailer and in towing configuration, utilizes one or more brake/turn signals, 30, mounted on top of the rear carriage uprights, 29, to signal traffic trailing the vehicle. During striping configuration, the brake/turn signals flash as hazard lights, when the vehicle's hazard lights are activated.

In FIG. 4, one or more strobe lights, 4, are mounted on one or more strobe light stands, 3, which can be attached to the telescoping boom, 67, and/or to the carriage, 68. The strobe lights are activated from the control box, 75. The strobe lights act to alert others of the operation of the invention and thus prevent accidents. In FIGS. 6*a*, 6*b*, 9, and 10, one or more flood lights, 20, are mounted at various locations on the carriage and positioned such that the flood lights can illuminate the carriage, the paint applicator, the reflective bead applicator, and the surface being striped in-front of and behind the carriage. Thus, the work area is brightly illuminated even if the work is occurring at night or in an unlit building. The flood lights are activated from the control box, 75. The placement of the strobe lights and flood lights are flexible in that they could be placed in various positions on the apparatus and still perform their function. In addition, other types of warning systems can be utilized, such as horns, sirens, flashing lights, etc. Also, other types of lights can be used to illuminate the work area, such as lights placed along the work area or lights attached to other vehicles.

In this invention, the bead applicators can have various components and ways to apply beads to the surface. A bead applicator can be a bead hopper having a bead dispensing opening which can be opened and shut or a bead hopper attached to a bead dispenser via a connector. It is possible for the bead dispenser to use gravity, pressurized air, or other forces to push/pull the beads out of the bead dispensing opening or the bead dispenser. In the preferred embodiment the bead dispenser uses gravity to pull beads from the bead dispenser. In this preferred embodiment, gravity also causes the beads to flow from the bead hopper to the bead dispenser through the connector.

The paint applicators can use any non-dedicated airless paint systems for the application of paint or it can use a proprietary paint spray gun system. The paint applicator has a spray gun holder which holds the paint spray guns of any type of paint spray gun painting system and a spray gun trigger which, when activated by the control box, causes the paint spray gun to release paint. The paint spray gun painting system may be mounted in or on the bed of the vehicle, except for the paint spray guns, and could possibly have a paint pump, a gasoline engine, one or more paint containers, tubing or tubings to carry paint to the spray guns, and one or more paint spray guns. While any paint spray gun painting system may be used, the preferred embodiment uses an airless walk behind striping machine.

As shown in FIGS. 5, 9, 10, and 11, in the preferred embodiment, the paint applicator has one or more spray gun holsters, 28, attached to the lower section of the carriage. A spray gun holster holds a paint spray gun. Each spray gun holster is mounted to a holster arm, 80, which is mounted to a gun mounting rod, 46, which is attached to one of the crossbeams, 78, on the carriage. A rod clamp, 76, is adjustable; permitting one to adjust the position of the spray gun holsters, and to finely tune the distance between the surface be striped and the spray gun holsters. Paint delivery to the spray guns is controlled by twelve volt solenoid air valves, 79, and air cylinders, 48*a*. The solenoid air valves shift the flow of compressed air through conduits, 82, into parts of the double acting air cylinders, 48*a*. One end of the trigger cable, 65, which is a sleeved cable, is attached to the clevis end, 40, of the piston rod, 87, of the air cylinder, 48*a*. The other end of the trigger cable is attached to the holster arm, 80. This holster arm, inherit in any non-dedicated airless walk behind striping machine that utilizes a manual cable triggering system for releasing paint through the spray gun, may be adapted for remotely controlled paint dispensing by this apparatus. As the compressed air enters port A, or port B, the piston rod extends, or retracts respectively. The trigger cable, in turn, is pulled or released which causes the holster trigger, 91, to extend or retract. Thus, one can control the delivery of paint by activating the solenoid air valves, which are controlled by a switch in the control box, 75. In the extended configuration, the holster arm does not compress the spray gun trigger, thus preventing paint from passing through the spray gun. In the retracted configuration, the holster arm compresses the spray gun trigger, allowing paint to be released through the spray gun. When one activates the paint spray guns, one applies elongated traffic control lines to the surface being striped.

Figure 10:
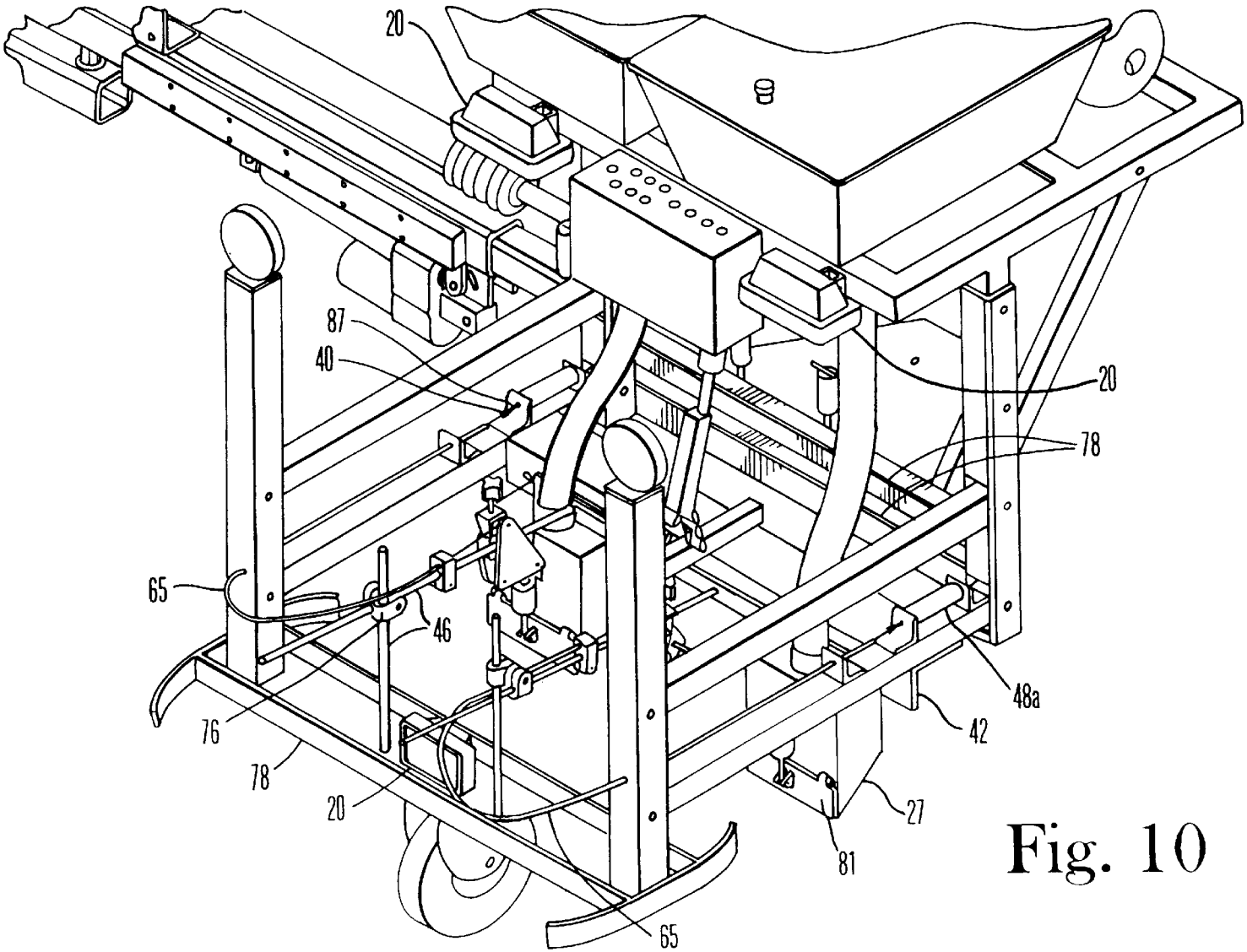
FIG. 10 is a perspective view of the carriage.
Figure 11:
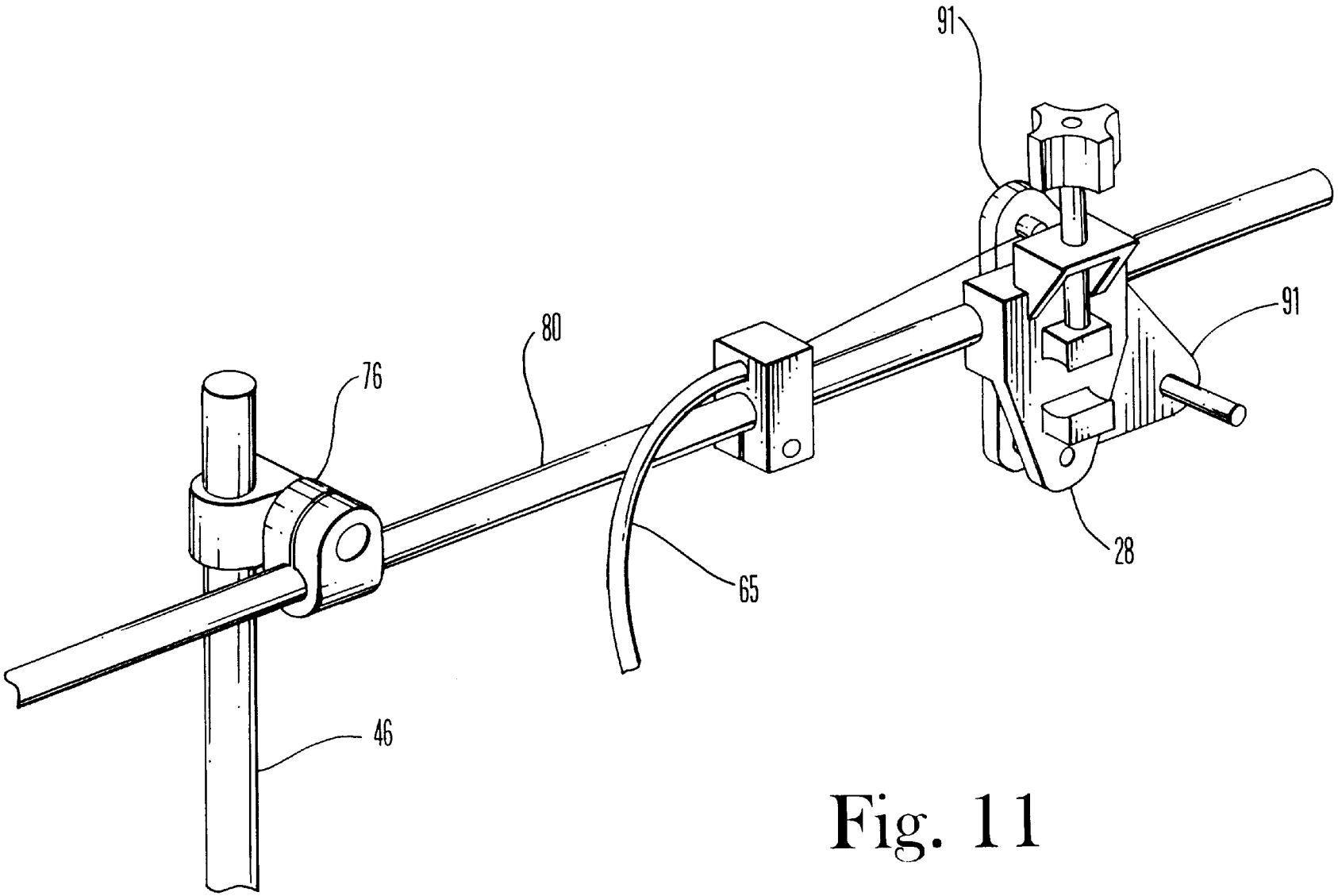
FIG. 11 is a detailed view of the spray gun holster mechanism of the carriage.

As shown in FIGS. 9 and 10, the gravity fed reflective bead applicator consists of one or more bead hoppers, 14; each bead hopper is connected to a bead hose, 45; and each bead hose is connected to a bead dispenser, 27. The reflective beads travel from the bead hopper through the bead hose to the bead dispenser. The bead hose must be of sufficient diameter and configuration to permit the reflective beads to flow freely down through the bead hose. The bead dispensers are mounted to the bead dispenser beam, 42. The bead dispenser beam is slotted to enable one to move the bead dispensers to any position along the bead dispenser beam. For each paint spray gun, one should have a corresponding bead dispenser which is aligned with the paint spray gun. In an alternative configuration, the invention can have one bead hopper with a plurality of bead hoses running from the bead hopper to two or more bead dispensers. Also, one can use a pump If to move the reflective beads by adding another pump to the carriage. In addition, one could mix the reflective beads and paint together prior to applying both to the surface. Another method involves having the reflective beads stored on the vehicle and mechanically moved via tubing and a pump from the vehicle to the surface of being striped.

Each bead dispenser, 27, has a gate, 81, which controls the flow of reflective beads out from the bead dispenser, 27, to the surface. The gate is opened and closed by an air cylinder, 48*b*, which in turn is controlled by a twelve volt solenoid air valve, 79. The solenoid air valve regulates the flow of pressurized air through an air line, 82, to the air cylinder, 48, The solenoid air valve in turn is controlled by a switch on the control box, 75. The reflective bead dispenser dispenses reflective beads onto the stripe, just painted by the preceding paint guns.

In an alternative embodiment, the bead applicator could be a bead hopper connected to a bead hose. At the other end of the bead hose is a vise-like constrictor, a sliding plate, or any similar item that could control the opening and closing of the bead hose. By having the vise-like constrictor, sliding plate, or similar item activated from the control box one could control the size and/or duration of the opening of the bead hose, thereby regulating the flow of beads out of the bead hose.

Figure 15:
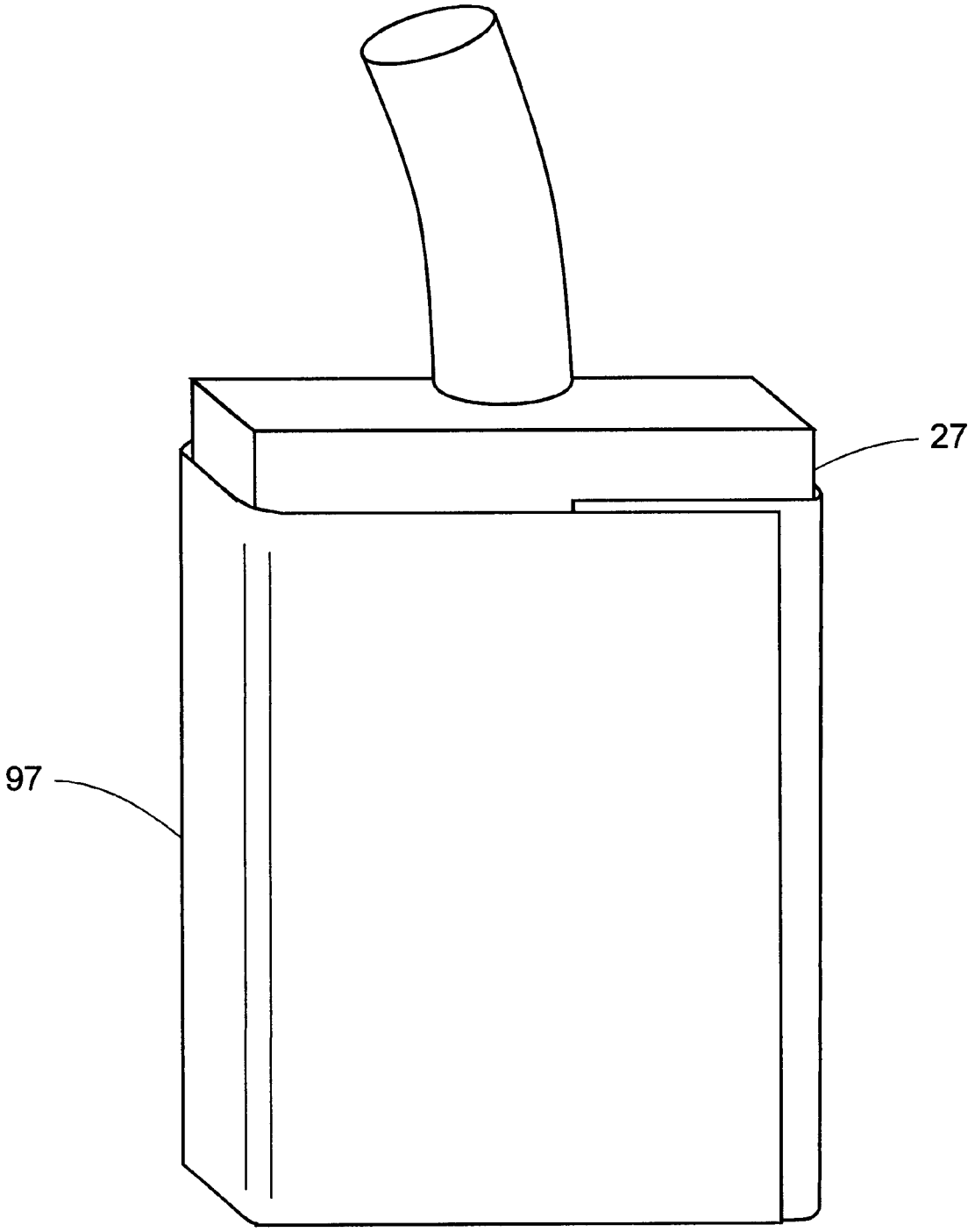
FIG. 15 is a detailed view of an alternative embodiment of the invention.

In an alternative embodiment (FIG. 15), a sleeve, 97, is attached to the bead dispenser and extends downward toward the surface. The sleeve is protects the beads from wind, paint, pressure from the spray gun, road debris, and other hazards which can interfere with application of the beads to the surface. The sleeve is easily removable from the bead dispenser to permit cleaning. The sleeve should have some rigidity to protect the beads but does not need to be so rigid that it can not bend if it hits road debris. The sleeve can be attached via pressure, Velcro, snaps, or any similar attachment mechanism.

Alternatively, the sleeve could be attached to the bead hose above the vise-like constrictor, sliding plate or other similar item that controls the opening and closing of the bead hose.

Air is compressed by a twelve volt air compressor, 17, and stored in an air tank, 16, at elevated pressure. Proper operating air pressure is maintained with a pressure switch, 77, and regulator, 63. Pressurized air is delivered through air conduits or lines to each of the solenoid air valve, 79. The solenoid air valve then passes the air to the air cylinders, 48*a* and 48*b,* via air lines, tubes, or conduits, 82.

In this preferred embodiment one should consider one spray gun holster, 28, and one bead dispenser, 27, as a pair. One solenoid air valve regulates both the holster trigger, 91, and the gate, 81, on each pair of spray gun holster and bead dispenser. As such, when the spray gun is triggered to release paint, so to is the bead dispenser opened to release reflective beads. In such a manner, the reflective beads can be applied to the newly applied paint on the surface. That is why it is important to align the bead dispenser with the corresponding spray gun holster. Furthermore, each solenoid air valve for each spray gun holster and bead dispenser pair is controlled by a switch on the control box, 75. As such, one should not apply paint without applying reflective beads.

However, other configurations are possible. Each spray gun holster and bead dispenser can have its own dedicated solenoid air valve. Also it is possible for one solenoid air valve to control more than one pair of spray gun holsters and bead dispensers.

For most applications, a line, or stripe width of 4 inches is used, but the width may be varied by using alternative spray tips, and/or varying the distance between the spray nozzles and the surface to be painted. Because the lift actuator can increase the distance between the lower section of the carriage and the surface, one can increase the width of the stripe by retracting the lift actuator and lifting the lower section of the carriage, including the pneumatic wheel, off the surface. In fact, one can operate the invention without having the pneumatic wheel even touching the surface, except then the skip timer and distance counter can not work.

Figure 12:
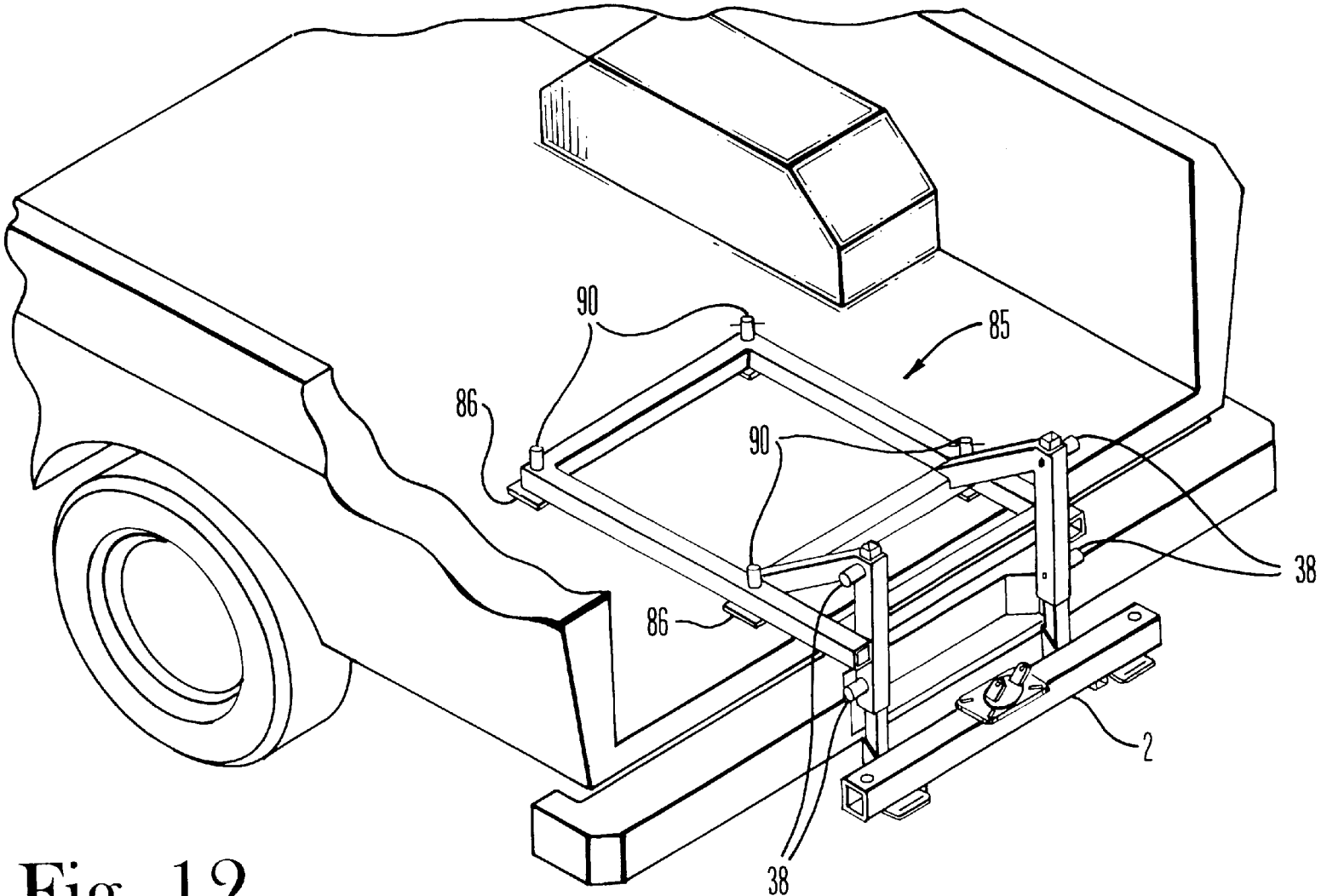
FIG. 12 is a perspective view of the skid mount framework attached to the rear of a vehicle.

In FIG. 12, the crossframe, 2, is securely mounted to a vehicle via a standard skid-mount framework, 85. The skid mount framework has adjustable members which can change the distance of the crossframe to the surface being painted. The skid mount framework is mounted to the bed of a truck or other vehicle via bolts, 90, and mounting plates, 86. The height is adjustable by using removable set pins, 38, to lock into place. The weight of the invention, including the carriage, telescoping boom, air compressor, air tank, bead hoppers, and bead dispensers, but excluding the prior art paint pumping system and paint containers, is supported by the skid mount framework. The prior art paint pumping system and paint container(s) are typically carried in the vehicle; such as, in the bed of a pickup truck. Other means of attaching the invention to a vehicle are known in the field.

Figure 13A:
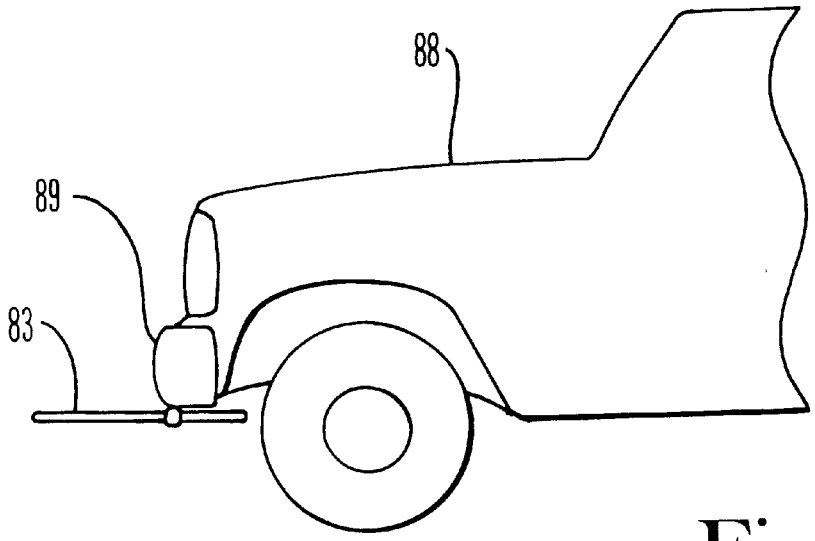
FIG. 13*a* is a side view of the line guide.
Figure 13B:
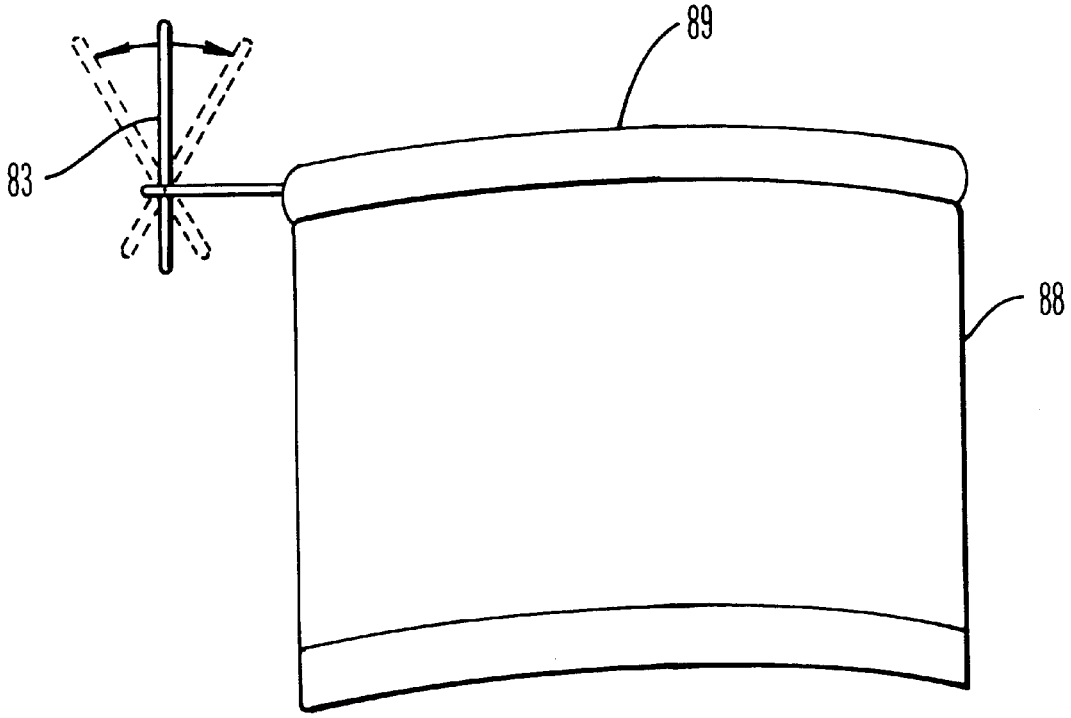
FIG. 13*b* is an overhead view of the line guide.

To assist in the application of paint and reflective beads in the proper place, in FIGS. 13*a* and 13*b,* a detachable, laterally adjustable line guide, 83, can be mounted to the front bumper, 89, of the vehicle, 88, which will assist the driver with keeping the vehicle in the proper position. The line guide is adjustable so that the driver can compensate for the optical illusion of the line guide being at an angle to the markings on the surface and thereby keep the line guide in proper position relative to the markings on the surface.

While the striping apparatus described herein is adaptable to many types of vehicles to which the skid mount framework may be mounted, it is anticipated that in most cases, a pickup truck will be utilized. Other systems of mounting the invention to a vehicle are known.

The striping apparatus can be stored in an unmounted position. Minimal effort and time are required for installing the apparatus on the vehicle, or removing it therefrom. Referring to FIG. 1, to change the striping apparatus from being vehicle-mounted to the unmounted position, the jack actuator, 6, is pivotally lowered by removing jack set pin, 71, and re-installing it into the jack housing, 31. The jack foot, 60, is removed from the foot mount, 59, by removing the set pin, 38. The jack foot is mounted on the jack actuator and the set pin is reinstalled through corresponding holes in each. The jack actuator is extended until the jack foot makes contact with the surface, thus supporting the apparatus. Then one detaches the apparatus from the swivel castor, 35, by removing the retaining pin, 55, and cross pin, 54. The prior art paint guns must be disengaged from the holsters, the electrical connector must be disconnected and the control box, 75, must be removed from the vehicle's driver compartment before the vehicle can be driven away. Once removed, the apparatus may be wheeled by one person to a storage location.

Figure 14:
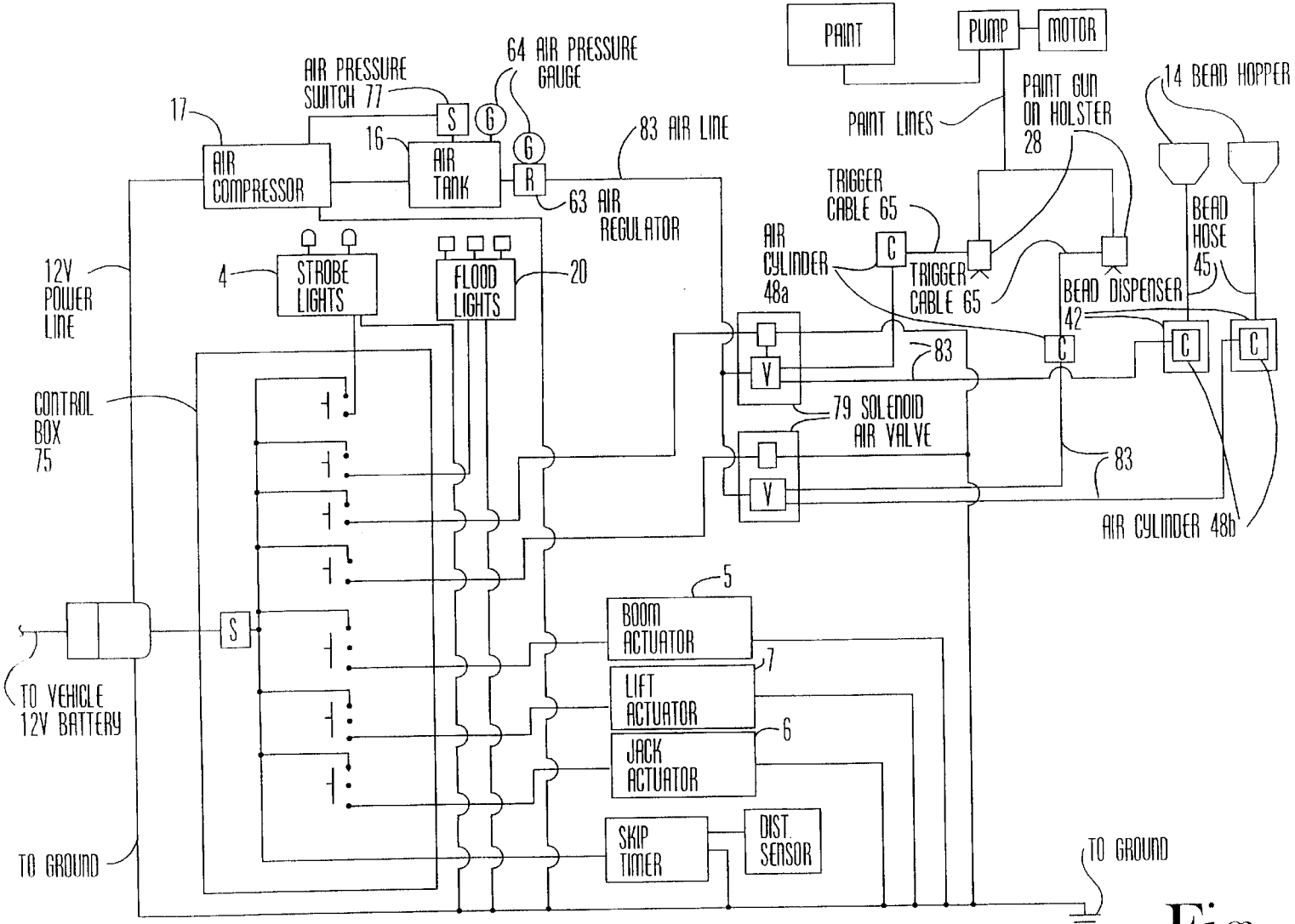
FIG. 14 is a schematic drawing of the control box and the arrangement of the various components of the invention.

A control box, 75, capable of controlling the application of paint and reflective beads, is schematically depicted in FIG. 14 as receiving twelve volt electrical power from the vehicle's electrical system through a connector and circuit breaking means or from a generator stored in the back of the vehicle. The control box typically includes a switch for activating the flood lights, 20, a switch for activating the strobe warning lights, 4, a switch for activating the boom actuator, 5, a switch for activating the lift actuator, 7, a switch for activating the jack actuator, 6, a switch for activating the skip timer controller, and a switch for activating each pair of holster arm, 80, and bead dispenser, 27, by controlling each solenoid air valve, 79. A schematic representation of the electrical, paint, air and bead circuits of the striping apparatus is included in FIG. 14. The line striping operations may be controlled from the cab by the vehicle's driver, enabling one person operation. The electrical power to operate all electrical equipment may derive from the vehicle's battery or a generator or battery located in the back of the vehicle.

It should be noted that in most of the drawings, the electrical lines and air lines have been removed so that one can see the components of the invention better. The electrical lines and air lines are flexible and bend when necessary during the movement of the apparatus.

Although the invention refers to the application of reflective beads to the surface, one can use any material which would reflect light. Such material could be metal beads or smoothen metal chips, smoothen glass fragments, or any similar material. Of course, the bead hoppers, bead hoses, and bead dispensers can accommodate most reflective materials or can be easily modified to accommodate the material. Furthermore, the spray gun holster, gun mounting rods, and rod clamps are just one method of attaching known spray gun equipment to the apparatus. Some other methods include attaching the spray guns via rods, tubes, clamps, vices, a holder, or the similar, to a crossbeam, to a beam attached to the bead dispenser, to the carriage uprights, or to any other part of the carriage so long as the paint is applied to the surface prior to the reflective beads being applied and so long as one can align a bead dispenser with a spray gun. Finally, although an electro-mechanical actuator is the preferred method of extending and retracting the various components of the invention, hydraulic jacks, purely mechanical extension devices, and the such exist which can be substituted.

Specific compositions, methods, or embodiments discussed are intended to be only illustrative of the invention disclosed by this specification. Variations on these compositions, methods, or embodiments are readily apparent to a person skilled in the art of this invention and are intended to be included in as part of the inventions disclosed herein.

I claim:

1. An apparatus for the application of paint and beads to a surface comprising:

a telescoping boom pivotally and detachably securable to the rear of a vehicle at a first pivot joint defining a boom-vehicle attachment point, said boom being capable of pivoting around the first pivot joint;

a boom actuator attached to said telescoping boom;

a wheeled carriage securely and pivotally attached to said telescoping boom at a second pivot joint defining a boom-carriage attachment point, said carriage being capable of pivoting around the boom-carriage attachment point;

at least one bead applicator attached to said carriage;

at least one paint applicator attached to said carriage;

a height controller attached to said carriage whereby said height controller controls the height of said paint applicator and said bead applicator from the surface;

and a control box to control said bead applicator, said boom actuator, said paint applicator, and said height controller.

2. The apparatus for the application of paint and beads to a surface as in claim 1, wherein:

said carriage has an upper section and a lower section;

said bead applicator comprises a bead hopper attached to said lower section of said carriage and a bead dispensing opening in said bead hopper wherein said bead dispensing opening can be selectively opened and selectively shut to control the dispensing of beads;

said paint applicator comprises a spray gun holder attached to said lower section of said carriage;

and said height controller comprises a lift actuator attached at one end to said upper section of said carriage and attached at an other end to said lower section of said carriage and pivotable control arms connecting said upper section of said carriage to said lower section of said carriage.

3. The apparatus for the application of paint and beads to a surface as in claim 2, wherein:

said bead applicator further comprises a sleeve attached to said bead dispensing opening and extending below said bead dispensing opening whereby said sleeve protects the beads from the wind while the beads are being applied to a surface.

4. The apparatus for the application of paint and beads to a surface as in claim 3, further comprising:

warning lights attached to said carriage;

work-illuminating lights attached to said carriage;

a wheel attached to said carriage;

a skip timer attached to said wheel;

and a distance timer attached to said wheel.

5. The apparatus for the application of paint and beads to a surface as in claim 1, wherein:

said carriage has an upper section and a lower section; said bead applicator comprises a bead hopper attached to said lower section of said carriage and a bead dispensing opening in said bead hopper wherein said bead dispensing opening can be selectively opened and selectively shut to control the dispensing of beads;

said paint applicator comprises a paint spray gun attached to said lower section of said carriage and operable from said control box;

said height controller comprises a lift actuator attached to said upper section of said carriage and said lower section of said carriage, and pivotable control arms connecting said upper section of said carriage to said lower section of said carriage.

6. The apparatus for the application of paint and beads to a surface as in claim 5, wherein:

said bead applicator further comprises a sleeve attached to said bead dispensing opening and extending below said bead dispensing opening whereby said sleeve protects the beads while the beads are being applied to a surface.

7. The apparatus for the application of paint and beads to a surface as in claim 6, further comprising:

warning lights attached to said carriage;

work-illuminating lights attached to said carriage;

a wheel attached to said carriage;

a skip timer attached to said wheel;

and a distance timer attached to said wheel.

8. An apparatus for the application of paint and beads to a surface comprising:

a telescoping boom pivotally and detachably securable to the rear of a vehicle at a first pivot joint and capable of pivoting around the boom-vehicle attachment point;

a boom actuator attached to said telescoping boom;

a wheeled carriage securely and pivotally attached to said telescoping boom at a second pivot joint and capable of pivoting around the boom-carriage attachment point wherein said carriage has an upper section and a lower section;

at least one bead applicator attached to said carriage;

at least one paint applicator attached to said carriage;

a height controller attached to said carriage whereby said height controller controls the height of said paint applicator and said bead applicator from the surface;

and a control box to control said bead applicator, said boom actuator, said paint applicator, and said height controller.

9. The apparatus for the application of paint and beads to a surface as in claim 8, wherein:

said bead applicator further comprises a bead hopper attached to an upper section of said carriage wherein said bead hopper has an opening for beads to exit said bead hopper, a bead dispenser attached to a lower section of said carriage wherein said bead dispenser can be selectively opened and selectively shut to control the release of beads, and a connector attached at one end to said bead dispenser and at an opposite end to said opening in said bead hopper whereby beads can flow from said bead hopper through said connector and into said bead dispenser; and said paint applicator comprises a spray gun holder attached to said lower section of said carriage.

10. The apparatus for the application of paint and beads to a surface as in claim 9, further comprising:

a sleeve attached to said bead dispenser and extending below said bead dispenser whereby said sleeve protects the beads while the beads are being applied to a surface;

warning lights attached to said carriage;

work-illuminating lights attached to said carriage;

a wheel attached to said carriage;

a skip timer attached to said wheel;

a distance timer attached to said wheel;

and a line guide detachably securable to the front of the vehicle.

11. The apparatus for the application of paint and beads to a surface as in claim 10, further comprising:

a jack pivotally attached to said telescoping boom wherein the height of the jack is adjustable.

12. The apparatus for the application of paint and beads to a surface as in claim 9, further comprising:

a jack pivotally attached to said telescoping boom wherein the height of the jack is adjustable.

13. An apparatus for the application of paint and beads to a surface comprising:

a telescoping boom pivotally and detachably securable to the rear of a vehicle at a boom-vehicle attachment point and capable of pivoting around the boom-vehicle attachment point;

a boom actuator attached to said telescoping boom;

a wheeled carriage securely and pivotally attached to said telescoping boom at a boom-carriage attachment point and capable of pivoting around the boom-carriage attachment point;

at least one bead applicator attached to said carriage, said bead applicator further comprising a bead hopper attached to an upper section of said carriage and having a gravity-fed opening for beads to exit said bead hopper, a bead dispenser attached to a lower section of said carriage wherein said bead dispenser can be selectively opened and selectively shut to control the release of beads, and a connector attached at one end to said bead dispenser and at an opposite end to said opening in said bead hopper whereby beads can flow from said bead hopper through said connector and into said bead dispenser;

a twelve volt paint applicator attached to said carriage and including a paint spray gun spray and a spray gun holder both attached to said lower section of said carriage; and a twelve volt control box connected to said bead dispenser, said boom actuator, and said paint applicator;

whereby the apparatus for the application of paint and beads to a surface may be powered entirely from a standard twelve volt vehicle battery.

* * * * *